US005311887A

United States Patent [19]

Ramsey

[11] Patent Number: 5,311,887

[45] Date of Patent: May 17, 1994

[54] COMB FOR HOLDING A LIQUID AND DISPENSING THE LIQUID THROUGH COMB TEETH

[76] Inventor: Floyd W. Ramsey, 608 NW. 116th Ter., Oklahoma City, Okla. 73114

[21] Appl. No.: 997,822

[22] Filed: Dec. 29, 1992

[51] Int. Cl.[5] ..... A45D 24/22

[52] U.S. Cl. ..... 132/114; 132/112; 401/268

[58] Field of Search ..... 132/112, 113, 114, 115, 132/116, 143; 401/17, 25, 26, 27, 268

[56] References Cited

U.S. PATENT DOCUMENTS

| | | | |
|---|---|---|---|
| 861,270 | 7/1907 | Cruttender | 433/89 |
| 1,088,797 | 3/1914 | Smith | 132/114 |
| 1,451,260 | 4/1923 | Holland . | |
| 1,475,786 | 11/1923 | Borstelman . | |
| 1,517,696 | 12/1924 | Balko . | |
| 1,667,631 | 4/1928 | Mach . | |
| 2,031,774 | 2/1936 | Helfrich et al. | 132/113 |
| 2,148,966 | 2/1939 | Schmidt . | |
| 3,101,086 | 8/1963 | Di Vito | 132/114 |
| 3,161,904 | 12/1964 | Goldich | 401/26 |
| 3,477,447 | 11/1969 | Eldredge . | |
| 4,209,027 | 6/1980 | Morganroth | 401/268 |
| 4,310,009 | 1/1982 | Shipp | 132/114 |
| 4,509,875 | 4/1985 | Shintani | 401/17 |
| 4,974,984 | 12/1990 | Kafkis et al. | 401/268 |
| 5,024,546 | 6/1991 | Guzman et al. | 401/25 |
| 5,054,504 | 10/1991 | Winrow | 132/114 |
| 5,056,480 | 10/1991 | Murray, Sr. . | |
| 5,094,556 | 3/1992 | Kohler | 401/268 |

FOREIGN PATENT DOCUMENTS

| | | | |
|---|---|---|---|
| 3917948 | 12/1990 | Fed. Rep. of Germany | 132/116 |

*Primary Examiner*—Gene Mancene
*Assistant Examiner*—Todd E. Manahan
*Attorney, Agent, or Firm*—Dunlap, Codding & Lee

[57] ABSTRACT

A comb for combing an individual's hair or scalp and applying a liquid to the individual's hair or scalp includes a reservoir connected to comb base and a plurality of comb teeth connected to the comb base. Liquid is disposed in the reservoir, passed through the comb base and through the comb teeth where the liquid is dispensed through the tooth outlets in the comb teeth. The reservoir, the comb base and the comb teeth are transparent so that the liquid and the dispensing of the liquid may be observed. The reservoir, the comb base and the comb teeth are constructed of a microwaveable material so that the comb may be disposed in a microwave for heating the liquid. The reservoir has a flat upper end so that the comb may be supported on the flat upper end of the reservoir in a storage position of the comb. The comb also includes a removable cover for covering the comb teeth and particularly the tooth outlets in the comb teeth for substantially preventing inadvertent leaking of the liquid through the tooth outlets when the comb is not in use. The comb also includes a supplemental comb tooth connected to the reservoir for applying liquid to the individual's hair or scalp.

47 Claims, 2 Drawing Sheets

COMB FOR HOLDING A LIQUID AND DISPENSING THE LIQUID THROUGH COMB TEETH

FIELD OF THE INVENTION

The present invention relates generally to combs and, more particularly, but not by way of limitation, to a comb for dispensing liquid through the comb teeth where the comb is constructed of a microwaveable material so that the liquid may be heated in a microwave while still in the comb, the comb also is constructed of a transparent material so that the liquid flow may be observed, the comb has a supplemental tooth for applying liquid to the individual's hair or scalp in a concentrated manner covering a smaller area, and the comb has a flat portion so that the comb may be supported on the flat portion in a storage position. The comb also includes a removable cover for covering the comb teeth and substantially preventing inadvertent dispensing of liquid through the comb teeth.

DESCRIPTION OF THE PREFERRED EMBODIMENTS

Figure 1:
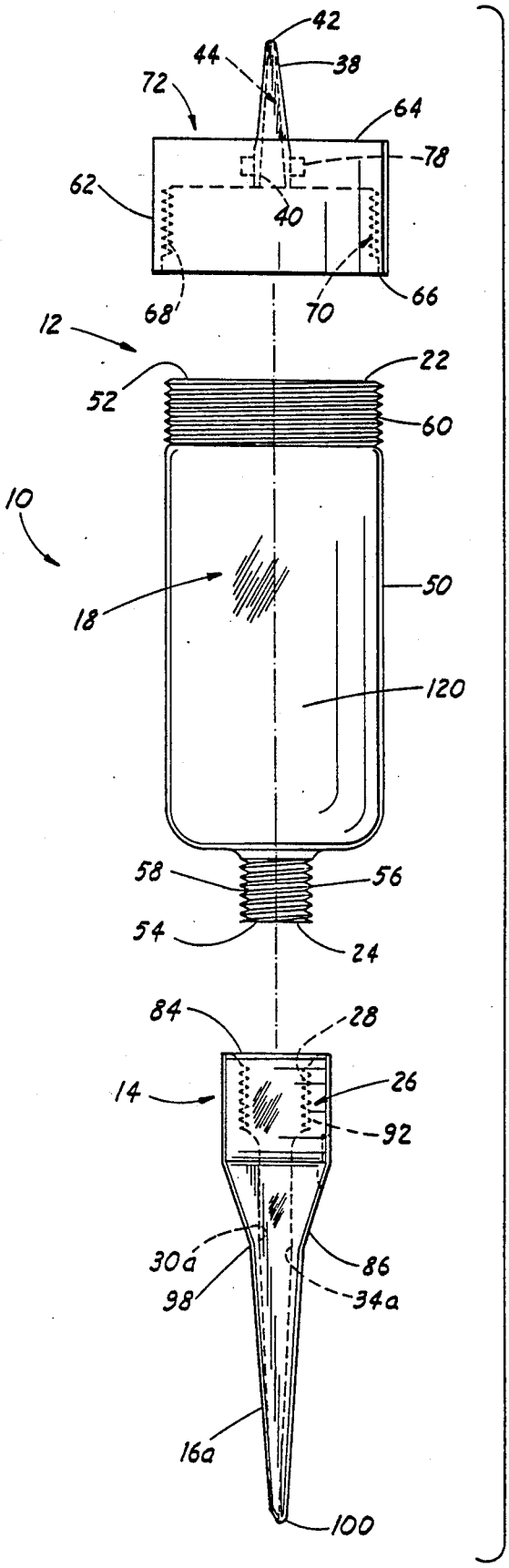
FIG. 1 is an exploded, side elevational view of a comb constructed in accordance with the present invention.
Figure 2:
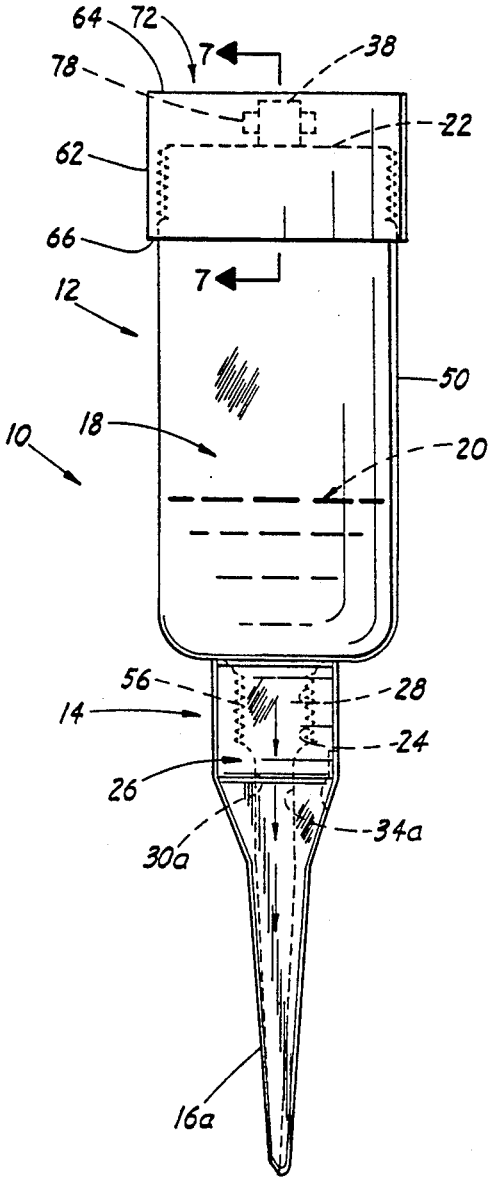
FIG. 2 is a side elevational view of the comb of FIG. 1 showing the components of the comb in an assembled position.
Figure 3:
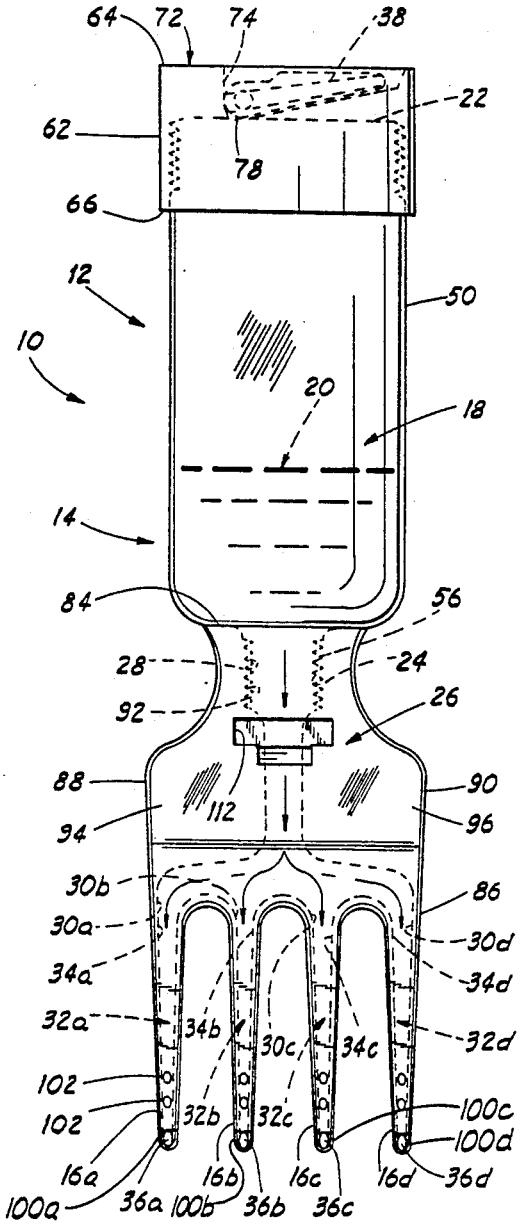
FIG. 3 is a front elevational view of the comb of FIGS. 1 and 2.

Shown in FIGS. 1, 2 and 3 and designated therein by the general reference numeral 10 is a comb constructed in accordance with the present invention. The comb 10 includes a reservoir 12, a comb base 14, and at least two comb teeth 16 with four comb teeth being shown in FIG. 3 and designated therein by the reference numerals 16*a*, 16*b*, 16*c* and 16*d*.

The reservoir 12 encompasses a reservoir space 18 adapted to store a quantity of liquid with the liquid being shown stored in the reservoir space 18 in FIGS. 2 and 3 and designated therein with the reference numeral 20. The reservoir 18 includes a reservoir inlet 22 and a reservoir outlet 24 with the reservoir inlet 22 and the reservoir outlet 24 each being in fluidic communication with the reservoir space 18.

The comb base 14 encompasses a base space 26. The comb base 14 has a base inlet 28 and at least two base outlets 30. More particularly, the comb base 14 as shown in FIG. 3 has four base outlets designated in FIG. 3 by the specific reference numerals 30*a*, 30*b*, 30*c* and 30*d*. The base inlet 28 and the base outlets 30 each are in fluidic communication with the base space 26.

The comb teeth 16 each encompass a tooth space 32. Each comb tooth 16 has a tooth inlet 34 and a tooth outlet 36. The tooth inlet 34 and the tooth outlet 36 of each of the comb teeth 16 are designated in FIG. 3 by the respective reference numerals 34*a*, 34*b*, 34*c* and 34*d* with respect to the tooth inlets 34 and with the reference numerals 36*a*, 36*b*, 36*c* and 36*d* with respect to the tooth outlets 36. The tooth inlet 34 and the tooth outlet 36 of each of the comb teeth 16 is in fluidic communication with the tooth space 32 of the respective comb tooth 16. The tooth spaces 32 of each of the comb teeth 16 are designated in FIG. 3 with the specific reference numerals 32*a*, 32*b*, 32*c* and 32*d*.

The reservoir 12 is connected to the comb base 14 and positioned so that the reservoir outlet 24 is in communication with the base inlet 28. The comb teeth 16 each are connected to the comb base 14 such that the base outlets 30 each are in communication with one of the tooth inlets 34. In a preferred embodiment, as shown in FIGS. 1, 2 and 3, the comb base 14 and the comb teeth 16 are integrally constructed and comprise a one piece, unitary construction. The reservoir 12 is constructed of a flexible material so that the reservoir 12 may be squeezed to assist in dispensing the liquid.

Figure 7:
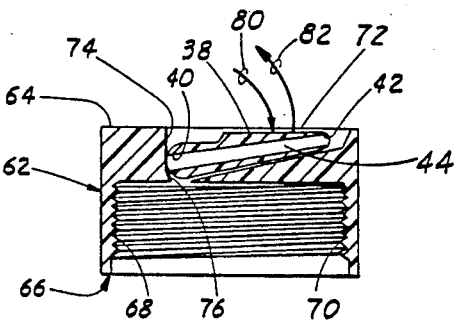
FIG. 7 is a sectional view of the cap portion of the comb, taken substantially along the lines 7—7 of FIG. 2.

A supplemental tooth 38 (FIGS. 1, 2, 3 and 7) is connected to the reservoir 12. The supplemental tooth 38 has a tooth inlet 40 (FIGS. 1 and 7) and a tooth outlet 42 (FIGS. 1 and 7). The supplemental tooth 38 encompasses a tooth space 44 (FIGS. 1 and 7). The tooth inlet 40 and the tooth outlet 42 of the supplemental tooth 38 each are in fluidic communication with the tooth space 44. The supplemental tooth 38 is pivotally connected to the reservoir 12 so that the supplemental tooth 38 may be pivotally moved to an operating position (FIG. 1) and to a storage position (FIGS. 3 and 7).

In operation, the reservoir 12 is connected to the comb base 14 having the comb teeth 16 connected thereto as shown in FIGS. 2 and 3. Liquid is disposed in the reservoir space 18 of the reservoir 12. The liquid 20 passes from the reservoir space 18 through the reservoir outlet 24 and through the base inlet 28 of the comb base 14 and into the base space 26. The liquid 20 passes from the base space 26 through the base outlets 30 and through the tooth inlets 34 into the tooth spaces 32. The liquid passes from the tooth spaces 32 through the tooth outlets 36 for dispensing the liquid onto the individual's hair or scalp. The individual holds the comb 10 by gripping the reservoir 12. The individual then positions the comb teeth 16 in the individual's hair or scalp and manipulates the comb 10 so that the liquid 20 is applied to the individual's hair or scalp by dispensing by gravity and/or squeezing the reservoir 12 the liquid 20 through the tooth outlets 36.

The liquid 20 may be any liquid which an individual desires to apply to the individual's hair or scalp. For example, the liquid may be a hair grease or a gel or a dye or a mousse.

If the individual desires to apply the liquid 20 to a small concentrated area, the individual moves the supplemental tooth 38 to the operating position. The individual then positions the supplemental tooth 38 in the individual's hair or scalp where the liquid 20 is passed from the reservoir space 18 through the reservoir inlet 22 and into the tooth space 44 of the supplemental tooth 38. The liquid 20 is passed from the tooth space 44 of the supplemental tooth 38 through the tooth outlet 42 where the liquid is applied to the individual's hair or scalp.

Figure 4:
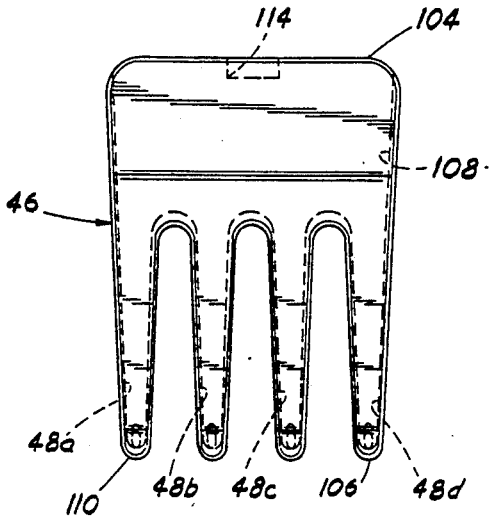
FIG. 4 is a front elevational view of a cover constructed in accordance with the present invention.
Figure 5:
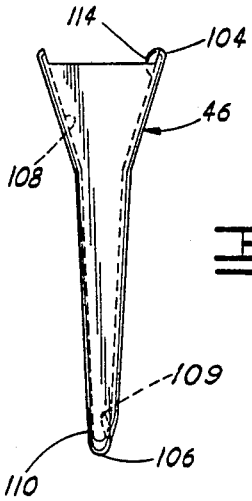
FIG. 5 is a side elevational view of the cover of FIG. 4.
Figure 6:
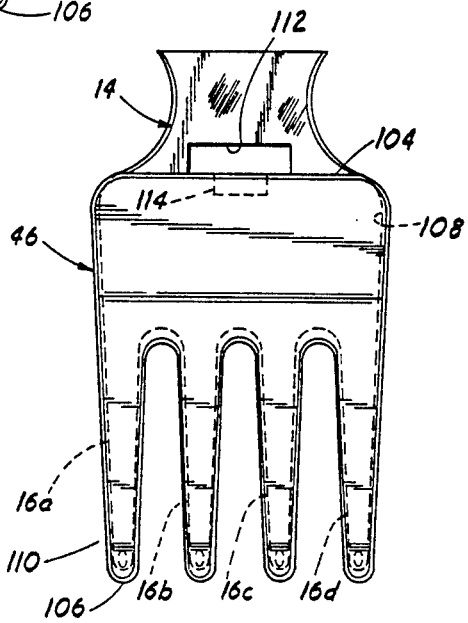
FIG. 6 is a front elevational view showing the cover of FIGS. 4 and 5 connected to the comb, only a portion of the comb being shown in FIG. 6.

The comb 10 also includes a cover 46 (FIGS. 4, 5 and 6). The cover 46 includes at least two tooth cavities 48.

More particularly, the cover 46 includes four tooth cavities 48 with the tooth cavities 48 being designated in FIG. 4 with the specific reference numerals 48*a*, 48*b*, 48*c* and 48*d*. Each of the tooth cavities 48 is shaped to receive one of the comb teeth 16 in an assembled position of the cover 46 (FIG. 6).

The cover 46 is disposed over the comb teeth 16 so that the comb teeth 16 each are positioned at one of the tooth cavities 48 of the cover 46. The cover 46 is removably connected to the comb teeth 16 for substantially preventing inadvertent dispensing of the liquid 20 through the tooth outlets 36 when the comb 10 is not in use.

The cover 46 must be disposed over the comb teeth 16 when using the supplemental tooth 38, Further, with the cover 46 on the comb teeth 16, the individual may use the cover 46 to style the individual's hair.

The reservoir 12, the comb base 14 and the comb teeth 16 preferably are constructed of a transparent material such as a transparent plastic. This enables the individual to observe the flow of the liquid 20 through the reservoir 12, the comb base 14 and the comb teeth 16 so the individual can determine the flowability of the liquid 20 within the comb 10.

In many instances, the liquid 20 becomes somewhat solidified between uses and, in such a state, the liquid 20 is not readily flowable through the reservoir 12, the comb base 14 and the comb teeth 16. The reservoir 12, the comb base 14 and the comb teeth 16 are constructed of a microwaveable material so that the individual can dispose the comb 10 in a microwave. The individual then operates the microwave to pass microwave energy through the comb 10 and the liquid 20 for heating the liquid 20 and rendering the liquid 20 flowable. The comb 10 then can be removed from the microwave and the heated liquid 20 is passable through the comb 10 and out the tooth outlets 36 for applying the liquid 20 to the individual's hair or scalp.

The reservoir 12 includes an elongated, cylindrically shaped reservoir member 50 (FIGS. 1, 2 and 3) having an upper end 52 (FIG. 1) and a lower end 54 (FIG. 1). A neckdown portion 56 (FIGS. 1, 2 and 3) is provided, one end forming the lower end 54. A portion of the outer peripheral surface of the neckdown portion 56 is threaded as indicated at 58 in FIG. 1. The reservoir outlet 24 more particularly extends through the neckdown portion 56 and intersects the lower end 54 of the reservoir member 50.

A portion of the outer peripheral surface of the upper end of the reservoir member 50 is threaded as indicated by the reference 60 in FIG. 1. The reservoir space 18 extends through the reservoir member 50 and intersects the upper end 52 of the reservoir member 50.

The reservoir 12 also includes a cap 62 (FIGS. 1, 2, 3 and 7) having an upper end 64 and a lower end 66. A cap opening 68 (FIGS. 1 and 7) is formed through the lower end 66 of the cap 62. The cap opening 68 extends a distance upwardly through the cap 62. A portion of the inner peripheral surface in the cap 62 formed by the cap opening 68 is threaded as indicated by the reference numeral 70 in FIGS. 1 and 7. The upper end 64 of the cap 62 is flat forming a flat support surface 72 (FIGS. 1, 2, 3 and 7). The flat support surface 72 is adapted so that the comb 10 may be supported on the flat support surface 72 in a non-use position of the comb 10.

A recess 74 (FIGS. 3 and 7) is formed in the upper end 64 of the cap 62. An opening 76 (FIG. 7) is formed in the cap 62 intersecting the recess 74 and the cap opening 68.

The supplemental tooth 38 is disposed in the recess 74. The recess 74 is sized so that the supplemental tooth 38 does not extend beyond the plane of the flat support surface 72 in a storage position of the supplemental tooth 38 as shown in FIGS. 2, 3 and 7. The supplemental tooth 38 is pivotally supported in the recess 74 via a shaft 78 (FIGS. 1, 2 and 3) which is connected to the cap 62 and pivotally connected to the supplemental tooth 38. The supplemental tooth 38 is pivotal in a direction 80 toward the recess 74 (FIG. 7) to the storage position wherein the supplemental tooth 38 is disposed in the recess 74. The supplemental tooth 78 also is pivotal in an opposite direction 82 (FIG. 7) to an operating position wherein the supplemental tooth 38 extends generally perpendicularly upwardly from the flat surface 72. In the operating position (FIG. 1) the tooth inlet 40 of the supplemental tooth 38 is in fluidic communication with the opening 76 in the cap 72 and the cap opening 68.

The cap 62 is removably connected to the upper end 52 of the reservoir member 50 via the threads 70 on the cap 62 and the threaded portion 60 on the outer peripheral surface of the reservoir member 50 near the upper end 52 thereof. To fill the reservoir space 18 with the liquid 20, the cap 62 is unthreadingly removed from the reservoir member 50. The liquid 20 then is poured or placed into the reservoir space 18 through the opening in the upper end 52 of the reservoir member 50 provided by the reservoir space 18 intersecting the upper end 52 of the reservoir member 50. The cap 62 then is pivotally connected to the upper end 52 of the reservoir member 50. In the assembled position, with the cap 62 connected to the reservoir member 50, the reservoir space 18 is in fluidic communication with the opening 76 in the cap 62 and the cap opening 68. The reservoir space 18 is not in fluidic communication with the tooth inlet 40 of the supplemental tooth 38 in the storage position with the supplement tooth 38 because a portion of the supplemental tooth 38 is pivoted over and closes the opening 76 in the cap 62 in the storage position of the supplement tooth 38.

When the supplemental tooth 38 is pivotally moved to the operating position, the tooth inlet 40 of the supplemental tooth 38 is in fluidic communication with the opening 76 in the cap 62 and thus in fluidic communication with the cap opening 68 and the reservoir space 18. In this position, the liquid 20 can flow by gravity and/or squeezing the reservoir 12 through the reservoir space 18, through the opening 76 and through the tooth inlet 40 of the supplemental tooth 38 thereby permitting the liquid 20 to flow through the tooth space 44 and out the tooth outlet 42 of the supplemental tooth 38. The opening 76 in the cap 62 provides what is sometime referred to herein as a supplemental reservoir outlet. Again, the cover 46 must be disposed over the comb teeth 16 when using the supplemental tooth 38.

As shown more clearly in FIGS. 1 and 3, the comb base 14 has an upper end 84, a lower end 86, a first side 88 and a second side 90. A threaded opening 92 (FIGS. 1 and 3) is formed through the upper end 84 and extends a distance from the upper end 84 toward the lower end 86. The threaded opening 92 is disposed about midway between the first and the second sides 88 and 90. The threaded opening 92 is shaped and adapted to threadingly receive the threaded neckdown portion 56 of the reservoir member 50.

The comb base 14 has a first portion 94 (FIG. 3) which extends a distance radially outwardly from the reservoir member 50 terminating with the first side 88. The comb base 14 has a second portion 96 (FIG. 3) which extends a distance radially outwardly in an opposite direction terminating with the second side 90. The first and the second portions 94 and 96 are aligned. The first portion 94 extends in one direction from the reservoir member 50 and the second portion 96 extends in the opposite direction from the reservoir member 50. The base outlets 30 extend through the lower end 86 of the comb base 14. The base inlet 28 extends through the upper end 84 of the comb base 14. The threaded opening 92 extends through the comb base 14 and intersects the base space 26.

The comb teeth 16 each have a base end 98 and an opposite tip end 100, as shown in FIG. 1 with respect to the comb tooth 16*a*. The tooth inlet 34 is formed through the base end 98 of each comb tooth 16 and the tooth outlet 36 is formed through the tip end 100 of each of the comb teeth 16. It should be noted that the tooth outlet 36 in each of the comb teeth 16 may be formed at any position on the comb tooth 16 and the comb tooth 16 may include a tooth outlet at the tip end 100 as shown in FIG. 3 and, in addition, it may include additional tooth outlets formed through the comb tooth 16 at positions between the base end 98 and the tip end 100. Tooth outlets 102 are shown in FIG. 3 with respect to the comb tooth 16*a* with the tooth outlets 102 being spaced between the base end 98 and the tip end 100*a* of the comb tooth 16*a* for example. Each of the comb teeth 16 may include tooth outlets like the tooth outlets 102 and/or the tooth outlet 36 in the tip end 100.

As shown in FIGS. 4, 5 and 6, the cover 46 has an upper end 104 and a lower end 106. A cover opening 108 extends through the upper end 104 and extends a distance generally toward the lower end 106. The cover opening 108 is shaped and adapted to receive a portion of the comb base 14 in an assembled position of the cover 46 and the comb base 14. The tooth cavities 48 are formed in the cover 46 by the cover opening 108 and each of the tooth cavities 48 intersects a portion of the cover opening 108. The cover 46 includes four fingers 110 (only one of the fingers 110 being designated with a reference numeral in FIGS. 4, 5 and 6). The tooth cavities 48*a*, 48*b*, 48*c* and 48*d* more particularly extend through each of the respective fingers 110. Each tooth cavity 48 is adapted to receive one of the comb teeth 16.

A tip 109 (FIG. 5) is disposed in each of the tooth cavities 48. Each tip 109 is removably disposed in one of the tooth outlets 36 when the cover 46 is disposed over the comb teeth 16 for cooperating to substantially prevent leakage.

A recess 112 (FIG. 3 and 6) is formed in the comb base 14. A snap ledge 114 (FIGS. 4, 5 and 6) is formed on the cover 46 with the snap ledge 114 being disposed generally in the cover opening 108.

In operation, the comb teeth 16 and the comb base 14 are inserted through the cover opening 108 to a position wherein each of the comb teeth 16 extends into and through one of the tooth cavities 48 formed in the fingers 110. In this position, a portion of the comb base 14 extends into the cover opening 108 and a portion of the cover 46 extends over a portion of the outer peripheral surface of the comb base 14. The comb base 14 and comb teeth 16 are inserted into the cover 46 to a position wherein the ledge 114 is snapped into the recess 112 thereby removably connecting the cover 46 to the comb base 14. The cover 46 covers the tooth outlets 36 for substantially preventing the liquid 20 from passing through the tooth outlets 36 when the comb 10 is not in use.

The reservoir member 50 has an axial centerline 120 (FIG. 1) extending therethrough intersecting the upper and the lower ends 52 and 54 thereof. The supplemental tooth 38 extends upwardly from the reservoir member 50 in the operating position of the supplemental tooth 38 with the supplemental tooth 38 extending in a direction substantially parallel with the axial centerline 120 of the reservoir member 50. The comb teeth 16 each extend downwardly from the reservoir member 50 in a direction substantially parallel with the axial centerline 120 of the reservoir member 50.

Changes may be made in the construction and the operation of the various components, elements and assemblies described herein and changes may be made in the steps or the sequence of steps of the methods described herein without departing from the spirit and scope of the invention as defined in the following claims.

What is claimed is:

1. A comb for combing an individual's hair or scalp and applying a liquid to the individual's hair or scalp comprising:

a reservoir encompassing a reservoir space, the reservoir comprising an elongated cylindrically shaped reservoir member having an upper end and a lower end, a reservoir inlet being formed through the upper end of the reservoir member and a reservoir outlet being formed through the lower end of the reservoir member, the reservoir space being adapted to store a quantity of liquid, the reservoir inlet and the reservoir outlet each being in fluidic communication with the reservoir space, the reservoir further comprising:

a cap having an upper end and a lower end with a cap opening being formed through the lower end of the cap and extending a distance through the lower end of the cap toward the upper end of the cap, the cap opening being sized to receive a portion of the reservoir member near the upper end thereof, the cap being removably connected to the upper end of the reservoir member with a portion of the reservoir member near the upper end thereof being disposed in the cap opening, the cap comprising a supplemental reservoir outlet formed through a portion thereof in fluidic communication with the reservoir space;

a comb base encompassing a base space having a base inlet and at least two base outlets, the base inlet and each of the base outlets being in fluidic communication with the base space;

at least two comb teeth, each comb tooth encompassing a tooth space and having a tooth inlet and a tooth outlet with each tooth inlet and each tooth outlet in each comb tooth being in fluidic communication with the tooth space in the comb tooth, the reservoir being connected to the comb base with the reservoir outlet being in fluidic communication with the base inlet and each comb tooth being connected to the comb base with each tooth inlet being in fluidic communication with one of the base outlets, the liquid being disposable in the reservoir space and the liquid being passable from the reservoir space through the reservoir outlet and through the base inlet and into the base space, and the liquid being passable from the base space through each of the base outlets and through the tooth inlet of each of the comb teeth and into the tooth space of each comb tooth, and the liquid being passable from the tooth space of each of the comb teeth out through the tooth outlets for applying the liquid to the individual's hair or scalp, the reservoir and the comb base and the comb teeth each being constructed of a transparent material whereby the flow of liquid from the reservoir space through the base space and through the tooth spaces is observable by the individual; and a supplemental tooth encompassing a tooth space and having a tooth inlet in fluidic communication with the tooth space and a tooth outlet in fluidic communication with the tooth space, the supplemental tooth being movably connected to the upper end of the cap for moving the supplemental tooth to an operating position and a storage position, the supplemental tooth extending a distance from the cap and the tooth inlet in the supplemental tooth being in fluidic communication with the supplemental reservoir outlet in the cap in the operating position of the supplemental tooth whereby liquid in the reservoir space is passable through the reservoir outlet and through the supplemental reservoir outlet and through the tooth inlet and through the tooth space and through the tooth outlet for dispensing liquid onto the individual's hair or scalp via the supplemental tooth, the tooth inlet in the supplemental tooth not being in fluidic communication with the reservoir space in the storage position of the supplemental tooth.

2. The comb of claim 1 wherein the upper end of the cap is defined further as being substantially flat whereby the comb may be disposed on a support surface with the substantially flat upper end of the cap being disposed adjacent the support surface and the comb being supported on the substantially flat upper end of the cap.

3. The comb of claim 1 wherein the cap is defined further to include a recess formed in the upper end thereof, and wherein the supplemental tooth is defined further as being disposed in the recess in the upper end of the cap with the supplemental tooth being movable to the storage position disposed within the recess and below the plane of the flat upper end of the cap in the storage position of the supplemental tooth.

4. The comb of claim 1 wherein the comb teeth extend a distance downwardly from the reservoir and wherein the supplemental tooth extends upwardly from the reservoir.

5. The comb of claim 1 wherein the reservoir has an axial centerline, and wherein the comb teeth extend downwardly from the reservoir in directions about parallel with the axial centerline of the reservoir and wherein the supplemental tooth extends upwardly from the reservoir in a direction about parallel with the axial centerline of the reservoir.

6. The comb of claim 1 wherein the comb base is defined further to comprise an upper end and a lower end and a first side and a second side with the base inlet being formed through the upper end and the base outlets being formed through the lower end of the comb base, the comb base having a first portion extending a distance radially outwardly from the reservoir terminating with the first side of the comb base and the comb base having a second portion extending a distance radially outwardly from the reservoir terminating with the second side of the comb base, the comb base having a rectangularly shaped cross-section.

7. The comb of claim 6 wherein each comb tooth is defined further as having a base end and a tip end with the tooth inlet being formed through the base end, the base end of each comb tooth being connected to the lower end of the comb base.

8. The comb of claim 1 further comprising:

a cover having at least two tooth cavities, each tooth cavity being shaped to receive one of the comb teeth, the cover being removably connected to the comb teeth with each comb tooth being removably disposed in one of the tooth cavities in the cover and the cover substantially closing the tooth outlets whereby liquid is not passable through the tooth outlets when the cover is connected to the comb teeth.

9. The comb of claim 8 wherein the cover further comprises an upper end and a lower end, a cover opening being formed through the upper end and extending a distance through the cover toward the lower end of the cover with the cover opening being shaped to receive a portion of the comb base, the tooth cavities being formed in the surface formed in the cover by the cover opening, a portion of the cover extending over a portion of the comb base with a portion of the comb base disposed in the cover opening of the cover when the cover is removably connected to the comb teeth and comb base.

10. A comb for combing an individual's hair or scalp and applying a liquid to the individual's hair or scalp comprising:

a reservoir encompassing a reservoir space, the reservoir comprising an elongated cylindrically shaped reservoir member having an upper end and a lower end, a reservoir inlet being formed through the upper end of the reservoir member and a reservoir outlet being formed through the lower end of the reservoir member, the reservoir space being adapted to store a quantity of liquid, the reservoir reservoir outlet each being in fluidic communication with the reservoir space.

a comb base encompassing a base space having a base inlet and at least two base outlets, the base inlet and each of the base outlets being in fluidic communication with the base space; and at least two comb teeth, each comb tooth encompassing a tooth space having a tooth inlet and a tooth outlet with each tooth inlet and each tooth outlet in each comb tooth being in fluidic communication with the tooth space in the comb tooth, the reservoir being connected to the comb base with the reservoir outlet being in fluidic communication with the base inlet and each comb tooth being connected to the comb base with each tooth inlet being in fluidic communication with one of the base outlets, the liquid being disposable in the reservoir space and the liquid being passable from the reservoir space through the reservoir outlet and through the base inlet and into the base space, and the liquid being passable from the base space through each of the base outlets and through the tooth inlet of each of the comb teeth and into the tooth space of each comb tooth, and the liquid being passable from the tooth space of each of the comb teeth out through the tooth outlets for applying the liquid to the individual's hair or scalp;

wherein the reservoir is defined further to include a supplemental reservoir outlet in fluidic communication with the reservoir space;

a supplemental tooth encompassing a tooth space and having a tooth inlet in fluidic communication with the tooth space and a tooth outlet in fluidic communication with the tooth space, the supplemental tooth being movably connected to the reservoir for moving the supplemental tooth to an operating position and a storage position, the supplemental tooth extending a distance from the reservoir and the tooth inlet in the supplemental tooth being in fluidic communication with the supplemental reservoir outlet in the reservoir in the operating position of the supplemental tooth whereby liquid in the reservoir space is passable through the reservoir outlet and through the supplemental reservoir outlet and through the tooth inlet and through the tooth space and through the tooth outlet for dispensing liquid onto the individual's hair of scalp via the supplemental tooth, the tooth inlet in the supplemental tooth not being in fluidic communication with the reservoir space in the storage position of the supplemental tooth; and a cap having an upper end and a lower end with a cap opening being formed through the lower end of the cap and extending a distance through the lower end of the cap toward the upper end of the cap, the cap opening being sized to receive a portion of the reservoir member near the upper end thereof, the cap being removably connected to the upper end of the reservoir member with a portion of the reservoir member near the upper end thereof being disposed in the cap opening, the supplemental reservoir outlet being formed through a portion of the cap.

11. The comb of claim 10 wherein the upper end of the cap is defined further as being substantially flat whereby the comb may be disposed on a support surface with the substantially flat upper end of the cap being disposed adjacent the support surface and the comb being supported on the substantially flat upper end of the cap.

12. The comb of claim 10 wherein the cap is defined further to include a recess formed in the upper end thereof, and wherein the supplemental tooth is defined further as being disposed in the recess in the upper end of the cap with the supplemental tooth being movable to the storage position disposed within the recess and below the plane of the flat upper end of the cap in the storage position of the supplemental tooth.

13. The comb of claim 10 wherein the comb teeth extend a distance downwardly from the reservoir and wherein the supplemental tooth extends upwardly from the reservoir.

14. The comb of claim 10 wherein the reservoir has an axial centerline, and wherein the comb teeth extend downwardly from the reservoir in directions about parallel with the axial centerline of the reservoir and wherein the supplemental tooth extends upwardly from the reservoir in a direction about parallel with the axial centerline of the reservoir.

15. The comb of claim 10 wherein the comb base is defined further to comprise an upper end and a lower end and a first side and a second side with the base inlet being formed through the upper end and the base outlets being formed through the lower end of the comb base, the comb base having a first portion extending a distance radially outwardly from the reservoir terminating with the first side of the comb base and the comb base having a second portion extending a distance radially outwardly from the reservoir terminating with the second side of the comb base, the comb base having a rectangularly shaped cross-section.

16. The comb of claim 15 wherein each comb tooth is defined further as having a base end and a tip end with the tooth inlet being formed through the base end, the base end of each comb tooth being connected to the lower end of the comb base.

17. The comb of claim 10 further comprising:

a cover having at least two tooth cavities, each tooth cavity being shaped to receive one of the comb teeth, the cover being removably connected to the comb teeth with each comb tooth being removably disposed in one of the tooth cavities in the cover and the cover substantially closing the tooth outlets whereby liquid is not passable through the tooth outlets when the cover is connected to the comb teeth.

18. The comb of claim 17 wherein the cover further comprises an upper end and a lower end, a cover opening being formed through the upper end and extending a distance through the cover toward the lower end of the cover with the cover opening being shaped to receive a portion of the comb base, the tooth cavities being formed in the surface formed in the cover by the cover opening, a portion of the cover extending over a portion of the comb base with a portion of the comb base disposed in the cover opening of the cover when the cover is removably connected to the comb teeth and comb base.

19. A comb for combing an individual's hair or scalp and applying a liquid to the individual's hair or scalp comprising:

a reservoir encompassing a reservoir space, the reservoir comprising an elongated cylindrically shaped reservoir member having an upper end and a lower end, a reservoir inlet being formed through the upper end of the reservoir member and a reservoir outlet being formed through the lower end of the reservoir member, the reservoir space being adapted to store a quantity of liquid, the reservoir inlet and the reservoir outlet each being in fluidic communication with the reservoir space;

a comb encompassing a base space having a base inlet and at least two base outlets, the base inlet and each of the base outlets being in fluidic communication with the base space;

at least two comb teeth, each comb tooth encompassing a tooth space and having a tooth inlet and a tooth outlet with each tooth inlet and each tooth outlet in each comb tooth being in fluidic communication with the tooth space in the comb tooth, the reservoir being connected to the comb base with the reservoir outlet being in fluidic communication with the base inlet and each comb tooth being connected to the comb base with each tooth inlet being in fluidic communication with one of the base outlets, the liquid being disposable in the reservoir space and the liquid being passable from the reservoir space through the reservoir outlet and through the base inlet and into the base space, and the liquid being passable from the base space through each of the base outlets and through the tooth inlet of each of the comb teeth and into the tooth space of each comb tooth, and the liquid being passable from the tooth space of each of the comb teeth out through the tooth outlets for applying the liquid to the individual's hair or scalp; wherein the reservoir includes a substantially flat end, the comb being disposable on a support surface with the substantially flat end of the reservoir being disposed adjacent the support surface and the comb being supported on the substantially flat end of the reservoir;

a cap having an upper end and a lower end with a cap opening being formed through the lower end of the cap and extending a distance through the lower end of the cap toward the upper end of the cap, the cap opening being sized to receive a portion of the reservoir member near the upper end thereof, the cap being removably connected to the upper end of the reservoir member with a portion of the reservoir member near the upper end thereof being disposed in the cap opening, the upper end of the cap forming the substantially flat end of the reservoir, the cap including a supplemental reservoir outlet formed through a portion thereof in fluidic communication with the reservoir space; and a supplemental tooth encompassing a tooth space and having a tooth inlet in fluidic communication with the tooth space and a tooth outlet in fluidic communication with the tooth space, the supplemental tooth being movably connected to the upper end of the cap for moving the supplemental tooth to an operating position and a storage position, the supplemental tooth extending a distance from the cap and the tooth inlet in the supplemental tooth being in fluidic communication with the supplemental reservoir outlet in the cap in the operating position of the supplemental tooth whereby liquid in the reservoir space is passable through the reservoir outlet and through the supplemental reservoir outlet and through the tooth inlet and through the tooth space and through the tooth outlet for dispensing liquid onto the individual's hair or scalp via the supplemental tooth, the tooth inlet in the supplemental tooth not being in fluidic communication with the reservoir space in the storage position of the supplemental tooth.

20. The comb of claim 19 wherein the cap is defined further to include a recess formed in the upper end thereof, and wherein the supplemental tooth is defined further as being disposed in the recess in the upper end of the cap with the supplemental tooth being movable to the storage position disposed within the recess and below the plane of the flat upper end of the cap in the storage position of the supplemental tooth.

21. The comb of claim 19 wherein the comb teeth extend a distance downwardly from the reservoir and wherein the supplemental tooth extends upwardly from the reservoir.

22. The comb of claim 19 wherein the reservoir has an axial centerline, and wherein the comb teeth extend downwardly from the reservoir in directions about parallel with the axial centerline of the reservoir and wherein the supplemental tooth extends upwardly from the reservoir in a direction about parallel with the axial centerline of the reservoir.

23. The comb of claim 19 in the comb base is defined further to comprise an upper end and a lower end and a first side and a second side with the base inlet being formed through the upper end and the base outlets being formed through the lower end of the comb base, the comb base having a first portion extending a distance radially outwardly from the reservoir terminating with the first side of the comb base and the comb base having a second portion extending a distance radially outwardly from the reservoir terminating with the second side of the comb base, the comb base having a rectangularly shaped cross-section.

24. The comb of claim 23 wherein each comb tooth is defined further as having a base end and a tip end with the tooth inlet being formed through the base end, the base end of each comb tooth being connected to the lower end of the comb base.

25. The comb of claim 19 further comprising:

a cover having at least two tooth cavities, each tooth cavity being shaped to receive one of the comb teeth, the cover being removably connected to the comb teeth with each comb tooth being removably disposed in one of the tooth cavities in the cover and the cover substantially closing the tooth outlets whereby liquid is not passable through the tooth outlets when the cover is connected to the comb teeth.

26. The comb of claim 25 wherein the cover further comprises an upper end and a lower end, a cover opening being formed through the upper end and extending a distance through the cover toward the lower end of the cover with the cover opening being shaped to receive a portion of the comb base, the tooth cavities being formed in the surface formed in the cover by the cover opening, a portion of the cover extending over a portion of the comb base with a portion of the comb base disposed in the cover opening of the cover when the cover is removably connected to the comb teeth and comb base.

27. A comb for combing an individual's hair or scalp and applying a liquid to the individual's hair or scalp comprising:

a reservoir encompassing a reservoir space adapted to store a quantity of liquid having a reservoir inlet and a reservoir outlet with the reservoir inlet and the reservoir outlet each being in fluidic communication with the reservoir space, the reservoir comprising an elongated cylindrically shaped reservoir member having an upper end and a lower end, the reservoir inlet being formed through the upper end of the reservoir member and the reservoir outlet being formed through the lower end of the reservoir member;

a comb base encompassing a base space having a base inlet and at least two base outlets, the base inlet and each of the base outlets being in fluidic communication with the base space; and at least two comb teeth, each comb tooth encompassing a tooth space and having a tooth inlet and a tooth outlet with each tooth inlet and each tooth outlet in each comb tooth being in fluidic communication with the tooth space in the comb tooth, the reservoir being connected to the comb base with the reservoir outlet being in fluidic communication with the base inlet and each comb tooth being connected to the comb base with each tooth inlet being in fluidic communication with one of the base outlets, the liquid being disposable in the reservoir space and the liquid being passable from the reservoir space through the reservoir outlet and through the base inlet and into the base space, and the liquid being passable from the base space through each of the base outlets and through the tooth inlet of each of the comb teeth and into the tooth space of each comb tooth, and the liquid being passable from the tooth space of each of the comb teeth out through the tooth outlets for applying the liquid to the individual's hair or scalp; and a cover having at least two tooth cavities, each tooth cavity being shaped to receive one of the comb teeth, the cover being removably connected to the comb teeth with each comb tooth being removably disposed in one of the tooth cavities in the cover and the cover substantially closing the tooth outlets whereby liquid is not passable through the tooth outlets when the cover is connected to the comb teeth; and a cap having an upper end and a lower end with a cap opening being formed through the lower end of the cap and extending a distance through the lower end of the cap toward the upper end of the cap, the cap opening being sized to receive a portion of the reservoir member near the upper end thereof, the cap being removably connected to the upper end of the reservoir member with a portion of the reservoir member near the upper end thereof being disposed in the cap opening, the cap including a supplemental reservoir outlet formed through a portion thereof in fluidic communication with the reservoir space;

a supplemental tooth encompassing a tooth space and having a tooth inlet in fluidic communication with the tooth space and a tooth outlet in fluidic communication with the tooth space, the supplemental tooth being movably connected to the upper end of the cap for moving the supplemental tooth to an operating position and a storage position, the supplemental tooth extending a distance from the cap and the tooth inlet in the supplemental tooth being in fluidic communication with the supplemental reservoir outlet in the cap in the operating position of the supplemental tooth whereby liquid in the reservoir space is passable through the reservoir outlet and through the supplemental reservoir outlet and through the tooth inlet and through the tooth space and through the tooth outlet for dispensing liquid onto the individual's hair or scalp via the supplemental tooth, the tooth inlet in the supplemental tooth not being in fluidic communication with the reservoir space in the storage position of the supplemental tooth.

28. The comb of claim 27 wherein the cover further comprises an upper end and a lower end, a cover opening being formed through the upper end and extending a distance through the cover toward the lower end of the cover with the cover opening being shaped to receive a portion of the comb base, the tooth cavities being formed in the surface formed in the cover by the cover opening, a portion of the cover extending over a portion of the comb base with a portion of the comb base disposed in the cover opening of the cover when the cover is removably connected to the comb teeth and comb base.

29. The comb of claim 27 wherein the upper end of the cap is defined further as being substantially flat whereby the comb may be disposed on a support surface with the substantially flat upper end of the cap being disposed adjacent the support surface and the comb being supported on the substantially flat upper end of the cap.

30. The comb of claim 27 wherein the cap is defined further to include a recess formed in the upper end thereof, and wherein the supplemental tooth is defined further as being disposed in the recess in the upper end of the cap with the supplemental tooth being movable to the storage position disposed within the recess and below the plane of the flat upper end of the cap in the storage position of the supplemental tooth.

31. The comb of claim 27 wherein the comb teeth extend a distance downwardly from the reservoir and wherein the supplemental tooth extends upwardly from the reservoir.

32. The comb of claim 27 wherein the reservoir has an axial centerline, and wherein the comb teeth extend downwardly from the reservoir in directions about parallel with the axial centerline of the reservoir and wherein the supplemental tooth extends upwardly from the reservoir in a direction about parallel with the axial centerline of the reservoir.

33. The comb of claim 27 wherein the comb base is defined further to comprise an upper end and a lower end and a first side and a second side with the base inlet being formed through the upper end and the base outlets being formed through the lower end of the comb base, the comb base having a first portion extending a distance radially outwardly from the reservoir terminating with the first side of the comb base and the comb base having a second portion extending a distance radially outwardly from the reservoir terminating with the second side of the comb base, the comb base having a rectangularly shaped cross-section.

34. The comb of claim 33 wherein each comb tooth is defined further as having a base end and a tip end with the tooth inlet being formed through the base end, the base end of each comb tooth being connected to the lower end of the comb base.

35. A comb for combing an individual's hair or scalp and applying a liquid to the individual's hair or scalp comprising:

a reservoir encompassing a reservoir space adapted to store a quantity of liquid having a reservoir inlet and a reservoir outlet with the reservoir inlet and the reservoir outlet each being in fluidic communication with the reservoir space, the reservoir comprising an elongated cylindrically shaped reservoir member having an upper end and a lower end, the reservoir inlet being formed through the upper end of the reservoir member and the reservoir outlet being formed through the lower end of the reservoir member;

a comb base encompassing a base space having a base inlet and at least two base outlets, the base inlet and each of the base outlets being in fluidic communication with the base space; and at least two comb teeth, each comb tooth encompassing a tooth space and having a tooth inlet and a tooth outlet with each tooth inlet and each tooth outlet in each comb tooth being in fluidic communication with the tooth space in the comb tooth, the reservoir being connected to the comb base with the reservoir outlet being in fluidic communication with the base inlet and each comb tooth being connected to the comb base with each tooth inlet being in fluidic communication with one of the base outlets, the liquid being disposable in the reservoir space and the liquid being passable from the reservoir space through the reservoir outlet and through the base inlet and into the base space, and the liquid being passable from the base space through each of the base outlets and through the tooth inlet of each of the comb teeth and into the tooth space of each comb tooth, and the liquid being passable from the tooth space of each of the comb teeth out through the tooth outlets for applying the liquid to the individual's hair or scalp, the reservoir and the comb base and the comb teeth each being constructed of a microwaveable material whereby the comb is placeable in a microwave for heating the liquid; and a cap having an upper end and a lower end with a cap opening being formed through the lower end of the cap and extending a distance through the lower end of the cap toward the upper end of the cap, the cap opening being sized to receive a portion of the reservoir member near the upper end thereof, the cap being removably connected to the upper end of the reservoir member with a portion of the reservoir member near the upper end thereof being disposed in the cap opening, the cap including a supplemental reservoir outlet formed through a portion thereof in fluidic communication with the reservoir space;

a supplemental tooth encompassing a tooth space and having a tooth inlet in fluidic communication with the tooth space and a tooth outlet in fluidic communication with the tooth space, the supplemental tooth being movably connected to the upper end of the cap for moving the supplemental tooth to an operating position and a storage position, the supplemental tooth extending a distance from the cap and the tooth inlet in the supplemental tooth being in fluidic communication with the supplemental reservoir outlet in the cap in the operating position of the supplemental tooth whereby liquid in the reservoir space is passable through the reservoir outlet and through the supplemental reservoir outlet and through the tooth inlet and through the tooth space and through the tooth outlet for dispensing liquid onto the individual's hair or scalp via the supplemental tooth, the tooth inlet in the supplemental tooth not being in fluidic communication with the reservoir space in the storage position of the supplemental tooth.

36. The comb of claim 35 wherein the upper end of the cap is defined further as being substantially flat whereby the comb may be disposed on a support surface with the substantially flat upper end of the cap being disposed adjacent the support surface and the comb being supported on the substantially flat upper end of the cap.

37. The comb of claim 35 wherein the cap is defined further to include a recess formed in the upper end thereof, and wherein the supplemental tooth is defined further as being disposed in the recess in the upper end of the cap with the supplemental tooth being movable to the storage position disposed within the recess and below the plane of the flat upper end of the cap in the storage position of the supplemental tooth.

38. The comb of claim 35 wherein the comb teeth extend a distance downwardly from the reservoir and wherein the supplemental tooth extends upwardly from the reservoir.

39. The comb of claim 35 wherein the reservoir has an axial centerline, and wherein the comb teeth extend downwardly from the reservoir in directions about parallel with the axial centerline of the reservoir and wherein the supplemental tooth extends upwardly from the reservoir in a direction about parallel with the axial centerline of the reservoir.

40. The comb of claim 35 wherein the comb base is defined further to comprise an upper end and a lower end and a first side and a second side with the base inlet being formed through the upper end and the base outlets being formed through the lower end of the comb base, the comb base having a first portion extending a distance radially outwardly from the reservoir terminating with the first side of the comb base and the comb base having a second portion extending a distance radially outwardly from the reservoir terminating with the second side of the comb base, the comb base having a rectangularly shaped cross-section.

41. The comb of claim 40 wherein each comb tooth is defined further as having a base end and a tip end with the tooth inlet being formed through the base end, the base end of each comb tooth being connected to the lower end of the comb base.

42. The comb of claim 35 further comprising:

a cover having at least two tooth cavities, each tooth cavity being shaped to receive one of the comb teeth, the cover being removably connected to the comb teeth with each comb tooth cavities in the cover and the cover substantially closing the tooth outlets whereby liquid is not passable through the tooth outlets when the cover is connected to the comb teeth.

43. A comb for combing an individual's hair or scalp and applying a liquid to the individual's hair or scalp comprising:

a reservoir encompassing a reservoir space adapted to store a quantity of liquid having a reservoir inlet and a reservoir outlet with the reservoir inlet and the reservoir outlet each being in fluidic communication with the reservoir space;

an elongated cylindrically shape reservoir member having an upper end and a lower end, the reservoir inlet being formed through the upper end of the reservoir member and the reservoir outlet being formed through the lower end of the reservoir member; and a cap having an upper end and a lower end with a cap opening being formed through the lower end of the cap and extending a distance through the lower end of the cap toward the upper end of the cap, the cap opening being sized to receive a portion of the reservoir member near the upper end thereof, the cap being removably connected to the upper end of the reservoir member with a portion of the reservoir member near the upper end thereof being disposed in the cap opening, the upper end of the cap being substantially flat whereby the comb is disposable on a support surface with the substantially flat upper end of the cap being disposed adjacent the support surface and the comb being supported on the substantially flat upper end of the cap, the cap having a supplemental reservoir outlet formed through a portion thereof in fluidic communication with the reservoir space;

a supplemental tooth encompassing a tooth space and having a tooth inlet in fluidic communication with the tooth space and a tooth outlet in fluidic communication with the tooth space, the supplemental tooth being movably connected to the upper end of the cap for moving the supplemental tooth to an operating position and a storage position, the supplemental tooth extending a distance from the cap and the tooth inlet in the supplemental tooth being in fluidic communication with the supplemental reservoir outlet in the cap in the operating position of the supplemental tooth whereby liquid in the reservoir space is passable through the reservoir outlet and through the supplemental reservoir outlet and through the tooth inlet and through the tooth space and through the tooth outlet for dispensing liquid onto the individual's hair or scalp via the supplemental tooth, the tooth inlet in the supplemental tooth not being in fluidic communication with the reservoir space in the storage position of the supplemental tooth;

a comb base encompassing a base space having a base inlet and at least two base outlets, the base inlet and each of the base outlets being in fluidic communication with the base space, the comb base having an upper end and a lower end and a first side and a second side with the base inlet being formed through the upper end and the base outlets being formed through the lower end of the comb base, the comb base having a first portion extending a distance radially outwardly from the reservoir terminating with the first side of the comb base and the comb base having a second portion extending a distance radially outwardly from the reservoir terminating with the second side of the comb base, the comb base having a rectangularly shaped cross-section;

at least two comb teeth, each comb tooth having a tooth inlet and a tooth outlet with each tooth inlet and each tooth outlet in each comb tooth being in fluidic communication with the tooth space in the comb tooth, the reservoir being connected to the comb base with the reservoir outlet being in fluidic communication with the base inlet and each comb tooth being connected to the comb base with each tooth inlet being in fluidic communication with one of the base outlets, the liquid being disposed in the reservoir space and the liquid being passable from the reservoir space through the reservoir outlet and through the base inlet and into the base space, and the liquid being passable from the base space through each of the base outlets and through the tooth inlet of each of the comb teeth and into the tooth space of each comb tooth, and the liquid being passable from the tooth space of each of the comb teeth out through the tooth outlets for applying the liquid to the individual's hair or scalp, the reservoir and the comb base and the comb teeth each being constructed of a transparent material whereby the flow of liquid from the reservoir space through the base space and through the tooth spaces is observable by the individual, the reservoir and the comb base and the comb teeth each being constructed of a microwaveable material whereby the comb is placeable in a microwave for heating the liquid, the reservoir having an axial centerline and the comb teeth each extending downwardly from the comb base in directions about parallel with the axial centerline of the reservoir and the supplemental tooth extending upwardly from the reservoir in a direction about parallel with the axial centerline of the reservoir; and a cover having at least two tooth cavities, each tooth cavity being shaped to receive one of the comb teeth, the cover being removably connected to the comb teeth with each comb tooth being removably disposed in one of the tooth cavities in the cover and the cover substantially closing the tooth outlets whereby liquid is not passable through the tooth outlets when the cover is connected to the comb teeth.

44. The comb of claim 43 wherein the cover further comprises an upper end and a lower end, a cover opening being formed through the upper end and extending a distance through the cover toward the lower end of the cover with the cover opening being shaped to receive a portion of the comb base, the tooth cavities being formed in the surface formed in the cover by the cover opening, a portion of the cover extending over a portion of the comb base with a portion of the comb base disposed in the cover opening of the cover when the cover is removably connected to the comb teeth and comb base.

45. The comb of claim 43 wherein the cap is defined further to include a recess formed in the upper end thereof, and wherein the supplemental tooth is defined further as being disposed in the recess in the upper end of the cap with the supplemental tooth being movable to the storage position disposed within the recess and below the plane of the flat upper end of the cap in the storage position of the supplemental tooth.

46. A method for applying liquid to an individual's hair or scalp comprising, providing a comb having a reservoir encompassing a reservoir space adapted to store a quantity of liquid having a reservoir inlet and a reservoir outlet with the reservoir inlet and the reservoir outlet each being in fluidic communication with the reservoir space, a comb base encompassing a base space having a base inlet and at least two base outlets, the base inlet and each of the base outlets being in fluidic communication with the base space and at least two comb teeth, each comb tooth encompassing a tooth space and having a tooth inlet and a tooth outlet with each tooth inlet and each tooth outlet in each comb tooth being in fluidic communication with the tooth space in the comb tooth, the reservoir being connected to the comb base with the reservoir outlet being in fluidic communication with the base inlet and each comb tooth being connected to the comb base with each tooth inlet being in fluidic communication with one of the base outlets, the liquid being disposable in the reservoir space and the liquid being passable from the reservoir space through the reservoir outlet and through the base inlet and into the base space, and the liquid being passable from the base space through each of the base outlets and through the tooth inlet of each of the comb teeth and into the tooth space of each comb tooth, and the liquid being passable from the tooth space of each of the comb teeth out through the tooth outlets for applying the liquid to the individual's hair or scalp, the reservoir and the comb base and the comb teeth each being constructed of a microwaveable material whereby the comb is placeable in a microwave for heating the liquid;

passing liquid into the reservoir space;

placing the comb in a microwave and passing microwave energy through the comb for heating the liquid and rendering the liquid flowable; and placing the comb teeth in the individual's hair or scalp with the liquid flowing from the reservoir space through the comb teeth and into the individual's hair or scalp.

47. A method for applying liquid to an individual's hair or scalp comprising, providing a comb having a reservoir encompassing a reservoir space adapted to store a quantity of liquid having a reservoir inlet and a reservoir outlet with the reservoir inlet and the reservoir outlet each being in fluidic communication with the reservoir space, a comb base encompassing a base space having a base inlet and at least two base outlets, the base inlet and each of the base outlets being in fluidic communication with the base space and at least two comb teeth, each comb tooth encompassing a tooth space and having a tooth inlet and a tooth outlet with each tooth inlet and each tooth outlet in each comb tooth being in fluidic communication with the tooth space in the comb tooth, the reservoir being connected to the comb base with the reservoir outlet being in fluidic communication with the base inlet and each comb tooth being connected to the comb base with each tooth inlet being in fluidic communication with one of the base outlets, the liquid being disposable in the reservoir space and the liquid being passable from the reservoir space through the reservoir outlet and through the base inlet and into the base space, and the liquid being passable from the base space through each of the base outlets and through the tooth inlet of each of the comb teeth and into the tooth space of each comb tooth, and the liquid being passable from the tooth space of each of the comb teeth out through the tooth outlets for applying the liquid to the individual's hair or scalp; and passing liquid into the reservoir space;

heating the liquid and rendering the liquid flowable; and placing the comb teeth in the individual's hair or scalp with the liquid flowing from the reservoir space through the comb teeth and into the individual's hair or scalp.

* * * * *